US007222468B2

(12) United States Patent
Liu

(10) Patent No.: US 7,222,468 B2
(45) Date of Patent: May 29, 2007

(54) DOORJAMB END CAP AND METHOD OF INSTALLATION THEREFOR

(76) Inventor: George Liu, 7710 Wentworth Dr., Duluth, GA (US) 30097

( * ) Notice: Subject to any disclaimer, the term of this patent is extended or adjusted under 35 U.S.C. 154(b) by 492 days.

(21) Appl. No.: 10/733,023

(22) Filed: Dec. 11, 2003

(65) Prior Publication Data

US 2005/0126089 A1 Jun. 16, 2005

(51) Int. Cl.
*E04B 1/14* (2006.01)

(52) U.S. Cl. ..... 52/741.3; 52/170; 52/212; 52/514; 52/515; 52/656.4; 52/656.5; 52/745.21; 52/204.54

(58) Field of Classification Search ..... 52/170, 52/204.66, 204.7, 212, 215, 656.4, 656.5, 52/741.3, 745.21, 514, 515, 204.54
See application file for complete search history.

(56) References Cited

U.S. PATENT DOCUMENTS

| | | | | |
|---|---|---|---|---|
| 2,875,481 | A | 3/1959 | Erkkila | |
| 3,521,404 | A | 7/1970 | Hager et al. | |
| 4,328,644 | A | 5/1982 | Scott et al. | |
| 4,430,830 | A | 2/1984 | Sailor | |
| 4,479,331 | A | 10/1984 | Bertolami et al. | |
| 4,922,661 | A | 5/1990 | Dallaire et al. | |
| 5,611,173 | A | 3/1997 | Headrick et al. | |
| 5,661,943 | A | 9/1997 | Hagel | |
| 5,687,518 | A | 11/1997 | Endo et al. | |
| 5,873,209 | A | 2/1999 | Hagel | |
| 5,901,510 | A | 5/1999 | Ellingson | |
| 5,950,391 | A | 9/1999 | Hagel | |
| 6,122,882 | A | 9/2000 | Hagel | |
| 6,161,343 | A | 12/2000 | Young | |
| 6,185,894 | B1 * | 2/2001 | Sisco et al. | 52/457 |
| 6,216,411 | B1 * | 4/2001 | Barnett | 52/656.4 |
| 6,357,197 | B1 | 3/2002 | Serino et al. | |
| 6,378,266 | B1 * | 4/2002 | Ellingson | 52/656.4 |
| 6,425,222 | B1 | 7/2002 | Hagel | |
| 6,446,410 | B1 | 9/2002 | Hagel | |
| 6,694,696 | B2 * | 2/2004 | Hagel | 52/656.4 |
| 2002/0178688 | A1 | 12/2002 | Hagel | |
| 2003/0005652 | A1 | 1/2003 | Hagel | |

FOREIGN PATENT DOCUMENTS

| | | | |
|---|---|---|---|
| GB | 002116427 | A | 11/1982 |

* cited by examiner

*Primary Examiner*—Jeanette E. Chapman
*Assistant Examiner*—Yvonne M. Horton
(74) *Attorney, Agent, or Firm*—Myers & Kaplan, LLC; Ashish D. Patel, Esq.; Barry E. Kaplan, Esq.

(57) ABSTRACT

A doorjamb end cap and method of installation therefor, wherein application of the present invention to wooden doorjambs permits the enclosed or encased portion thereof to effectively resist or avoid the onset of rot therein, and wherein the present invention is effectuated without expensive extrusion processes and/or thermoplastic melt and adhesive applications.

17 Claims, 5 Drawing Sheets

DOORJAMB END CAP AND METHOD OF INSTALLATION THEREFOR

TECHNICAL FIELD

The present invention relates generally to rot-resistant exterior building materials, and more specifically to a doorjamb end cap and method of installation therefor, wherein application of the present invention to wooden doorjambs permits the enclosed or encased portion thereof to effectively resist or avoid the onset of rot therein, wherein such rot is typically associated with the penetration or infusion of air and/or moisture into the wood material.

BACKGROUND OF THE INVENTION

Rain, snow and other harsh weather elements can have a devastating effect on the structural integrity of exterior building materials. Specifically, permeation and infusion of moisture and air into many exterior building materials can often result in the rot or decomposition of same. Wooden building materials, and especially wooden doorframes or doorjambs, are particularly susceptible to moisture and/or air-induced rot due the inherent porosity and fibrous or cellulosic composition of wood in general.

Unfortunately, and in the exemplary context of wooden doorframes or doorjambs, application of expensive exterior paints and/or sealants thereto do not provide sufficient long-term rot-resistant capabilities, as the structural, molecular or polymeric integrity of such paints and/or sealants is often disrupted or broken down by the infusion therein of moisture, air, dirt, dust and other foreign particulates. As such, paints or sealants applied to exterior wooden doorframes or doorjambs eventually peel from the surfaces thereof, and/or deteriorate in areas of greater molecular or polymeric breakdown; thus, exposing the wooden material therebeneath to the destructive forces of moisture, air and foreign particulates. Additionally, application of multiple layers of such paints and/or sealants often only exacerbates the problem, typically causing premature peeling due to the weak molecular bond between the layers, a structural deficiency most aptly attributed to an application process requiring the drying of individual paint/sealant layers prior to application of subsequent layers.

An alternative to the application of paints and/or sealants to wooden doorframes or doorjambs is to securely affix a plurality or an assembly of weathering plates to the exterior surfaces thereof. Such weathering plates are typically formed from plastic, cut or molded to shape, and affixed to the wooden doorframe or doorjamb via nails or wood screws. Unfortunately, because a multitude of such plates are typically assembled over the wooden structures, a plurality of gaps or spaces form between each adjacent or abutting plate, thereby providing several openings for the passage of moisture, air, and/or foreign particulates therethrough; thus, resulting in eventual rotting of the underlying wooden doorframe or doorjamb. Additionally, fastening such plates to the wooden structures via nails or screws create further openings or apertures for the introduction of air, moisture, and the like, therein and therethrough. Examples of such products may be seen with reference to U.S. Pat. No. 5,901,510 to Ellingson.

In an attempt to overcome the disadvantages associated with the application of paints, sealants, or weathering plates over wooden doorframes, doorjambs, or the like, many construction materials manufactures often apply or extrude thermoplastic melts and/or other hot melts over the wooden doorframe or doorjamb to provide a more permanent and structurally rot-resistant barrier thereover. However, the materials and equipment requirements of such extrusion processes render the application of such extrusion processes highly expensive, inefficient and, as such, impractical. Specifically, many thermoplastic melts are often extruded onto an adhesive-covered wooden doorframe, doorjamb, or core, and thereafter, permitted to cool. If the application process and curing of melt and adhesive is successful, the adhesive effectively forms a bond between the cooled melt and the wooden core. However, if the application process and curing of the melt and adhesive is unsuccessful, the cooled melt will often prematurely break free or peel away from the wooden core, exposing same to rot-inducing air and moisture elements, and resulting in excess materials waste in the long term. Additionally, even if successfully cooled and cured, such melt-adhesive based extrusions are not immune to fluctuations in extreme temperature, and, as such, may still peel or break free from the wooden core as a result of structural degradation of, or bonding failure between, the adhesive and melt. Furthermore, the extrusion dies and related equipment required to control flow, dimensions, and uniform application and thickness of thermoplastic melt over the wooden core, are often overly expensive, and, therefore, significantly contribute to the overall impracticality and high cost of such an extrusion process. Unfortunately, without such extrusion dies and machines, melts applied too thinly or non-uniformly over a wooden core are subject to cracking, premature peeling, and overall structural failure. Examples of such extrusion processes and products may be seen with reference to U.S. Pat. No. 6,357,197 to Serino et al., and U.S. Pat. No. 5,687,518 to Endo et al.

Although non-wooden doorframes, doorjambs, window frames, and the like, completely manufactured from extruded plastics or other rot-resistant materials are available, such solid-form extrusions are extremely expensive to manufacture, requiring expensive thermoplastic melts or powders and associated extrusion dies and machinery to extrude same.

An alternative to extruding entire doorframes or doorjambs from thermoplastic melts, compositions, or the like, is to only extrude a lower, non-load-bearing portion of the doorframe or doorjamb from extruded thermoplastics, or the like (i.e., areas of the doorframe/jamb especially susceptible to rot). Unfortunately, application of such products require an overly invasive and laborious method of installation, often necessitating the entire removal or excise of a desired (lower) portion of the door frame, replacement of the removed portion with a suitable extruded and cooled thermoplastic portion, and the securing of same. Still other methods of installation utilizing similar products require the creation of finger-joint connections in the ends of the extruded product and wooden doorframe/jamb, thereby facilitating end-to-end connection of same. Examples of such products may be seen with reference to U.S. Pat. No. 6,446,410 to Hagel, U.S. Pat. No. 6,425,222 to Hagel, U.S. Pat. No. 6,357,197 to Serino et al., U.S. Pat. No. 6,122,882 to Hagel, U.S. Pat. No. 5,950,391 to Hagel, U.S. Pat. No. 5,873,209 to Hagel, and U.S. Pat. No. 5,661,943 to Hagel.

Additionally, apparently absent from the prior art are protective doorjamb applications with integrally formed end caps that protect or shield the base or end of a doorjamb from the deleterious effects of air and moisture. Instead, some manufacturing processes include the use of end pieces or caps that may be added to the ends of a doorjamb during the extrusion of thermoplastic melts thereover. A product yielded as a result of such a process is seemingly structurally flawed, as the end piece and extruded melt, even with the use of adhesives, may not bond or cure properly, or may be susceptible to extreme temperatures and weather conditions, thereby resulting in the cooled melt prematurely breaking free or peeling away from the end piece; thus, exposing the underlying wooden doorjamb to rot-inducing air and moisture elements. Examples of such products may be seen with reference to U.S. Pat. No. 6,357,197 to Serino et al., and U.S. Pat. No. 5,687,518 to Endo et al.

As such, it appears that the inherent air/moisture-tight benefits of integrally formed end caps or boot-like enclosures for application onto doorjambs are not disclosed or taught in the prior art, nor is the combination of such closed-end, boot-like enclosures or end caps with the ends or lower portions of doorjambs.

Therefore, it is readily apparent that there is a need for a doorjamb end cap and method of installation therefor, wherein application of the present invention to wooden doorjambs permits the enclosed or encased portion thereof to effectively resist or avoid the onset of rot therein, and wherein the present invention is effectuated without expensive extrusion processes and/or thermoplastic melt and adhesive applications.

BRIEF SUMMARY OF THE INVENTION

Briefly described, in a preferred embodiment, the present invention overcomes the above-mentioned disadvantages and meets the recognized need for such a device by providing a doorjamb end cap and method of installation therefor, wherein a boot-like end cap dimensioned to slidably engage the end of a wooden doorjamb is integrally formed or molded as a single unit for purposes of structural integrity, and for effectively enclosing the end of a wooden doorjamb to shield same from rot-inducing air, moisture and foreign particulate. The method of installation, and general combination, of the present end cap with a doorjamb involves minimal effort and materials, and further incorporates foam fillers and sealants to provide the wooden doorjamb with additional air and moisture resistance. Advantageously, the present invention is effectuated without expensive extrusion processes and/or thermoplastic melt and adhesive applications.

According to its major aspects and broadly stated, the present invention in its preferred form is an integrally formed or single-molded doorjamb end cap dimensioned to engage the foot of a doorjamb formed from wood or other rot-susceptible materials, wherein an associated method of installation prohibits the entry of rot-inducing air, moisture, and/or foreign particulate such as dust, dirt, fungus spores, mold spores, or the like.

More specifically, the present invention is an integrally formed or single-molded doorjamb end cap, preferably in the form of a closed-end sleeve or shell, shaped, configured and dimensioned to engage preferably approximately the first 2 to 6 inches of the foot of a doorjamb, although any suitable length of the doorjamb could be encased. The doorjamb end cap is best applied to doorjambs formed from wood or other rot-susceptible materials, such as, for exemplary purposes only, wood and fiber composites, particle wood and adhesive composites, wood and plastic composites, wood and rubber composites, and/or similar porous materials. The end cap is preferably formed from polyvinylacetate (PVC), fiberglass, acrylics, acrylonitrile-butadiene-styrene (ABS), polycarbonate, polypropylene, rigid-polystyrene, polyethylene, polyolefin, and/or similar blends of non-porous plastics, and/or other rot-resistant materials, via injection molding processes and/or common thermoforming processes, such as pressure assisted thermoforming, drape forming, press forming, vacuum forming, and high-definition thermoforming. Thermoforming processes are particularly favored, as such processes involve low tool cost, short lead time to build a new tool, short setup time for small size runs, the ability to inexpensively manufacture large parts, and the ability to produce parts/products with superior stress crack resistance, high impact strength and good rigidity, as opposed to the above-discussed high manufacturing, materials and tooling expenses associated with extrusion processes, equipment, and dies.

As a result of the injection molding process and/or thermoforming process, the integrally formed, durable, closed-bottom end cap provides complete air and moisture-tight encasement of the doorjamb foot portion, and, therefore, prevents rotting of the doorjamb from the base upward; as opposed to current devices and methods that include the addition of a separately formed end piece or cap to the end of a doorjamb during the extrusion of thermoplastic melts thereover, thus potentially resulting in the cooled melt prematurely breaking free or peeling away from the end piece and exposing the underlying wooden doorjamb base to rot-inducing air and moisture elements.

Methods of application and installation of the present doorjamb end cap to post-manufactured doorjambs include scaling down the foot of the doorjamb to facilitate flush surface seating and engagement of the end cap thereover. To prohibit the entry of rot-inducing air, moisture, and/or foreign particulate such as dust, dirt, fungus spores, mold spores, or the like, within the fractional gap disposed between the inner surface of the end cap and the outer surface of the enclosed doorjamb foot portion, a polyurethane foaming and sealing agent, or other similar foaming agent or filler, is preferably injected therebetween. The seam formed between the upper edges of the end cap and the scaled-down portion of the doorjamb foot may be sealed via caulking, or other sealants, for creating an additional air and/or moisture barrier. The fully installed end cap, and the doorjamb in general, may then be painted, or provided with other suitable finish, to provide a more aesthetically pleasing product appearance.

With regard to methods of application and installation of the present doorjamb end cap to newly manufactured doorjambs and/or those undergoing manufacture, it is contemplated that the entire above-described method could be implemented, or, alternatively, that the doorjambs could be pre-manufactured with scaled-down foot portions to facilitate implementation and completion of the remaining end cap installation method.

In an alternate embodiment of the present invention, it is contemplated that the end cap could be manufactured to a sufficient dimension to permit fitting of same to the (scaled-down) foot or lower portion of a door itself, thus preventing rot of door base. Such a device could include a weather strip integrally formed therewith, and/or affixed thereto via adhesives, or the like.

In another alternate embodiment of the present invention, it is contemplated that the end cap could be modified to permit adaptation of same to window frames.

Accordingly, a feature and advantage of the present invention is its ability to effectively enclosing the end of a wooden doorjamb to shield same from rot-inducing air, moisture, and foreign particulates.

Another feature and advantage of the present invention is its integrally formed closed bottom.

Still another feature and advantage of the present invention is its ability to be manufactured with relatively low tooling and materials costs, as compared to prior-art methods.

Yet another feature and advantage of the present invention is its ability to be installed with relative ease, as compared to prior-art methods.

Yet still another feature and advantage of the present invention is its ability to prevent rot of doorjambs, window frames, and doors.

A further feature and advantage of the present invention is its ability to withstand harsh weather elements.

Yet still a further feature and advantage of the present invention is its simplicity of design.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATIVE EMBODIMENTS

In describing the preferred and alternate embodiments of the present invention, as illustrated in FIGS. 1-5, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
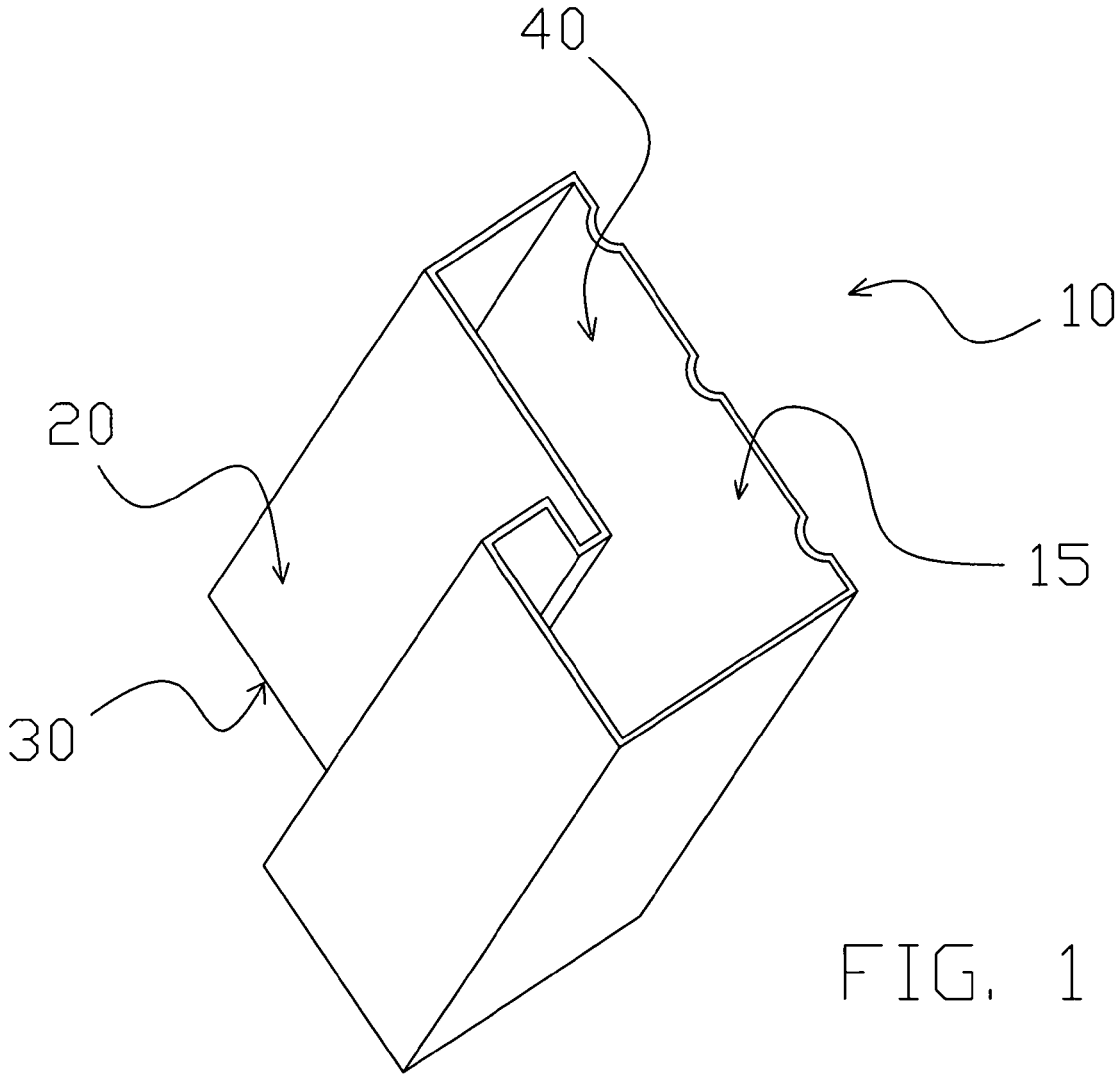
FIG. 1 is a perspective view of a doorjamb end cap according to a preferred embodiment of the present invention.

Referring now to FIG. 1, the present invention in a preferred embodiment is a doorjamb end cap 10, comprising peripheral wall 20 preferably integrally formed with bottom wall 30, wherein peripheral wall 20 and bottom wall 30 preferably define recess 40. End cap 10 is preferably suitably shaped, configured and dimensioned such that recess 40 receives and engages preferably approximately the first 2 to 6 inches of the foot of a conventional doorjamb, as more fully described below. It is contemplated, however, that any suitable length or portion of the doorjamb could be encased.

End cap 10 is preferably formed from polyvinyl-acetate (PVC), fiberglass, acrylics, acrylonitrile-butadiene-styrene (ABS), polycarbonate, polypropylene, rigid-polystyrene, polyethylene, polyolefin, and/or similar blends of non-porous plastics, and/or other rot-resistant materials. The material selected to form end cap 10 is preferably molded or shaped via injection molding processes and/or common thermoforming processes, such as pressure assisted thermoforming, drape forming, press forming, vacuum forming, and high-definition thermoforming. Thermoforming processes are particularly favored, as such processes involve low tool cost, short lead time to build a new tool, short setup time for small size runs, the ability to inexpensively manufacture large parts, and the ability to produce parts/products with superior stress crack resistance, high impact strength and good rigidity.

Preferably, as a result of the injection molding process and/or thermoforming process, the integrally formed, durable closed-bottom end cap 10 provides complete air and moisture-tight encasement of the doorjamb foot portion, and, therefore, prevents rotting of the underlying doorjamb portion.

Figure 2:
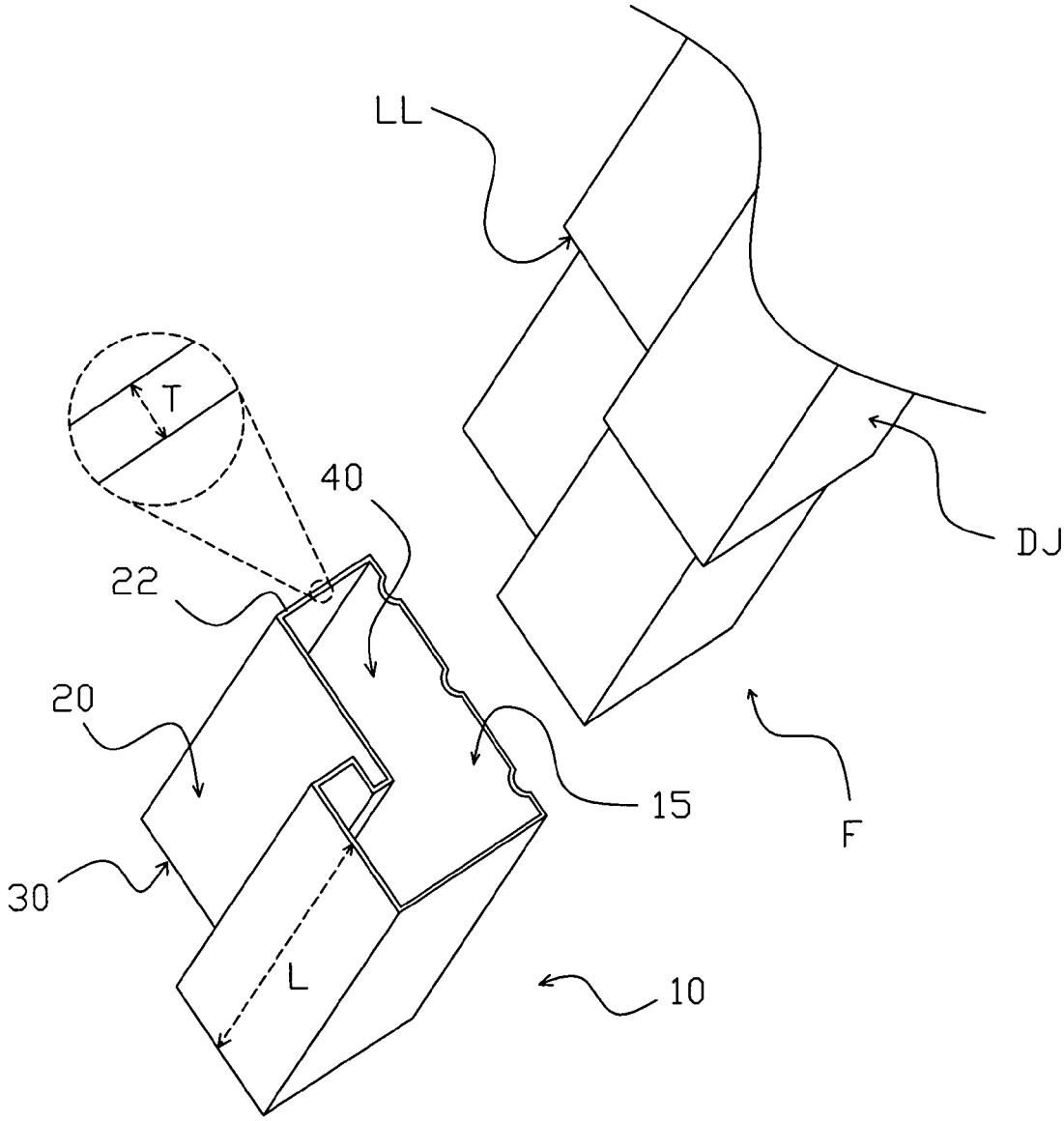
FIG. 2 is a perspective view of a doorjamb end cap according to a preferred embodiment of the present invention, illustrating a preferred method of installation.
Figure 3:
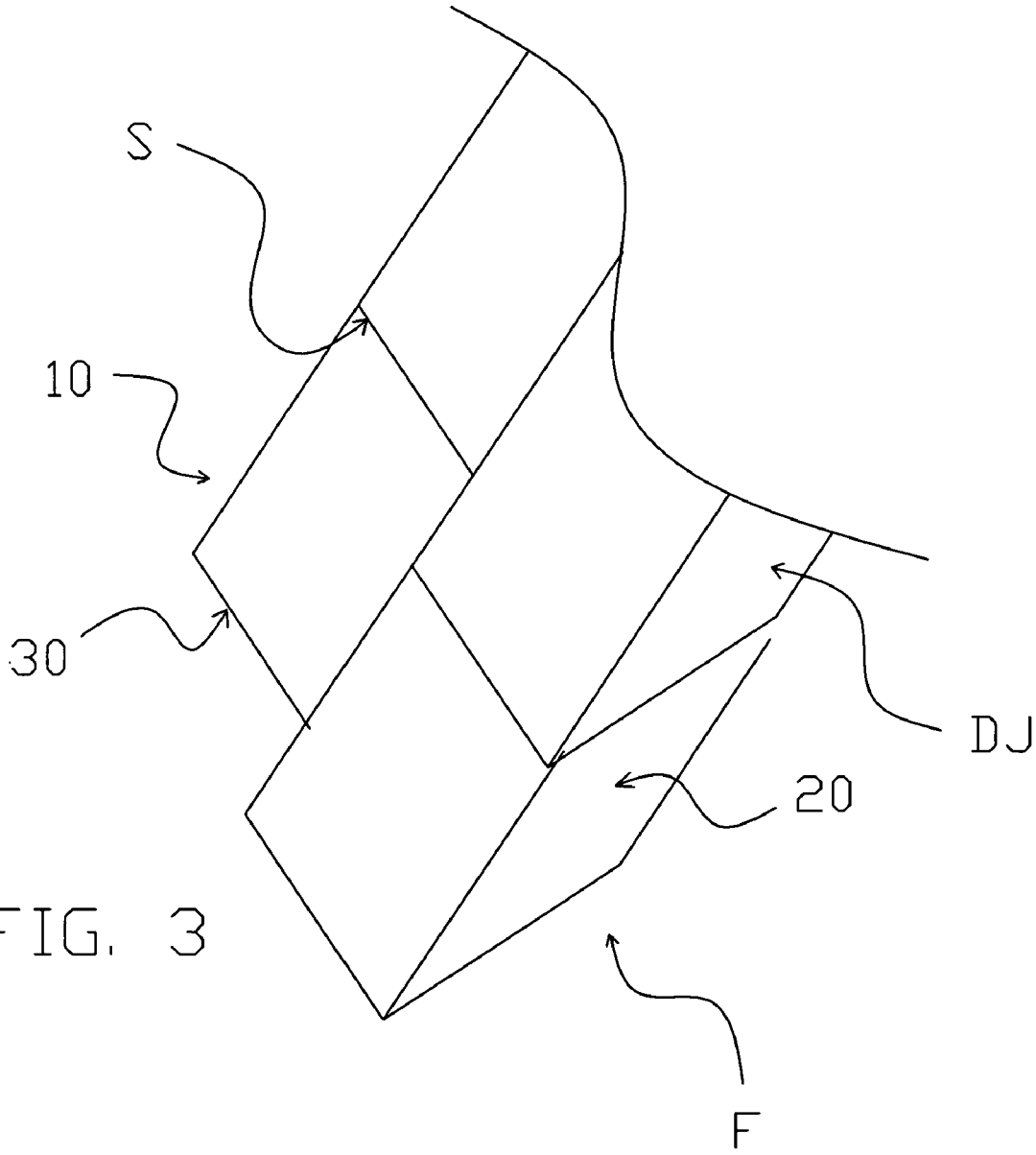
FIG. 3 is a perspective view of a doorjamb end cap according to a preferred embodiment of the present invention, shown installed.

Referring now more specifically to FIGS. 2-3, doorjamb end cap 10 is preferably applied to foot F of doorjamb DJ, wherein doorjamb DJ may be formed from wood or other rot-susceptible materials, such as, for exemplary purposes only, wood and fiber composites, particle wood and adhesive composites, wood and plastic composites, wood and rubber composites, and/or similar porous materials.

To facilitate flush surface seating and engagement of end cap 10 over foot F of doorjamb DJ, all surfaces of foot F are preferably shaved down or scaled down to a depth equivalent to the thickness T of peripheral wall 20, and to a length equivalent to the length L of peripheral wall 20, thereby creating lip LL on doorjamb DJ. Thereafter, end cap 10 is slidably engaged over foot F of doorjamb DJ, such that edge 22 of peripheral wall 20 abuts lip LL on doorjamb DJ.

To prohibit the entry of rot-inducing air, moisture, and/or foreign particulates such as dust, dirt, fungus spores, mold spores, or the like, within the fractional gap disposed between inner surface 15 of end cap 10 and the outer surface of foot F doorjamb DJ, a polyurethane foaming and sealing agent, or other similar foaming agent or filler, is preferably injected therebetween. Seam S is formed between peripheral edge 22 of peripheral wall 20 and lip LL of doorjamb DJ and is preferably sealed via caulking, or other sealants, for creating an additional air and/or moisture barrier. The fully installed end cap 10, and doorjamb DJ in general, may then be painted, or otherwise finished, to provide a more aesthetically pleasing product appearance.

It should be recognized, that although the above-described method of installation is preferably utilized for applying end cap 10 to post-manufactured doorjambs, such as those utilized at a construction site, it is contemplated that doorjamb end cap 10 could be applied to newly manufactured doorjambs and/or those undergoing manufacture via the above-described method. It is further contemplated that doorjambs, in general, could be pre-manufactured with scaled-down foot portions to facilitate implementation and completion of the remaining end cap 10 installation method as described above.

Figure 4:
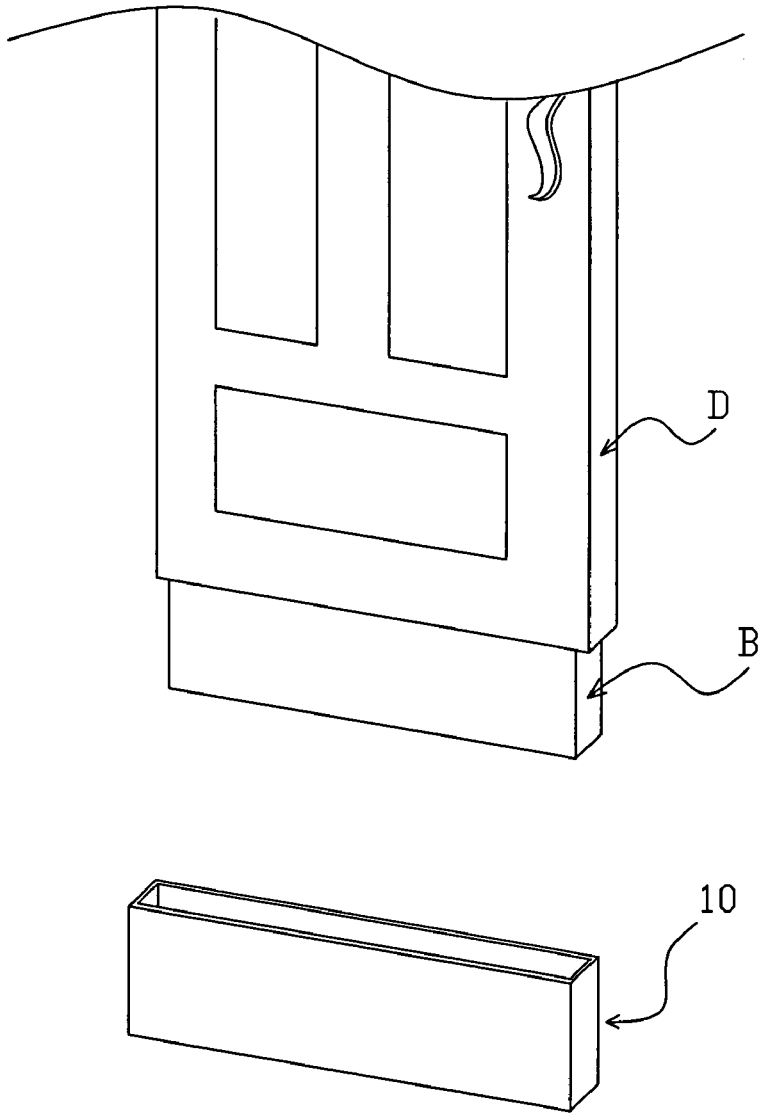
FIG. 4 is a perspective view of an end cap according to an alternate embodiment of the present invention, illustrating a preferred method of installation; and, FIG. 5 is a perspective view of an end cap according to an alternate embodiment of the present invention, illustrating a preferred method of installation.

Referring now more specifically to FIG. 4, illustrated therein is an alternate embodiment of end cap 10, wherein the alternate embodiment of FIG. 4 is substantially equivalent in form and function to that of the preferred embodiment detailed and illustrated in FIGS. 1-3 except as hereinafter specifically referenced. Specifically, the embodiment of FIG. 4 contemplates that end cap 10 could be manufactured to a sufficient dimension to permit fitting of same to the (scaled-down) foot or base portion B of door D itself; thus, preventing rot thereof. Such a device could include a weather strip integrally formed therewith and/or affixed thereto via adhesives, or the like.

Figure 5:
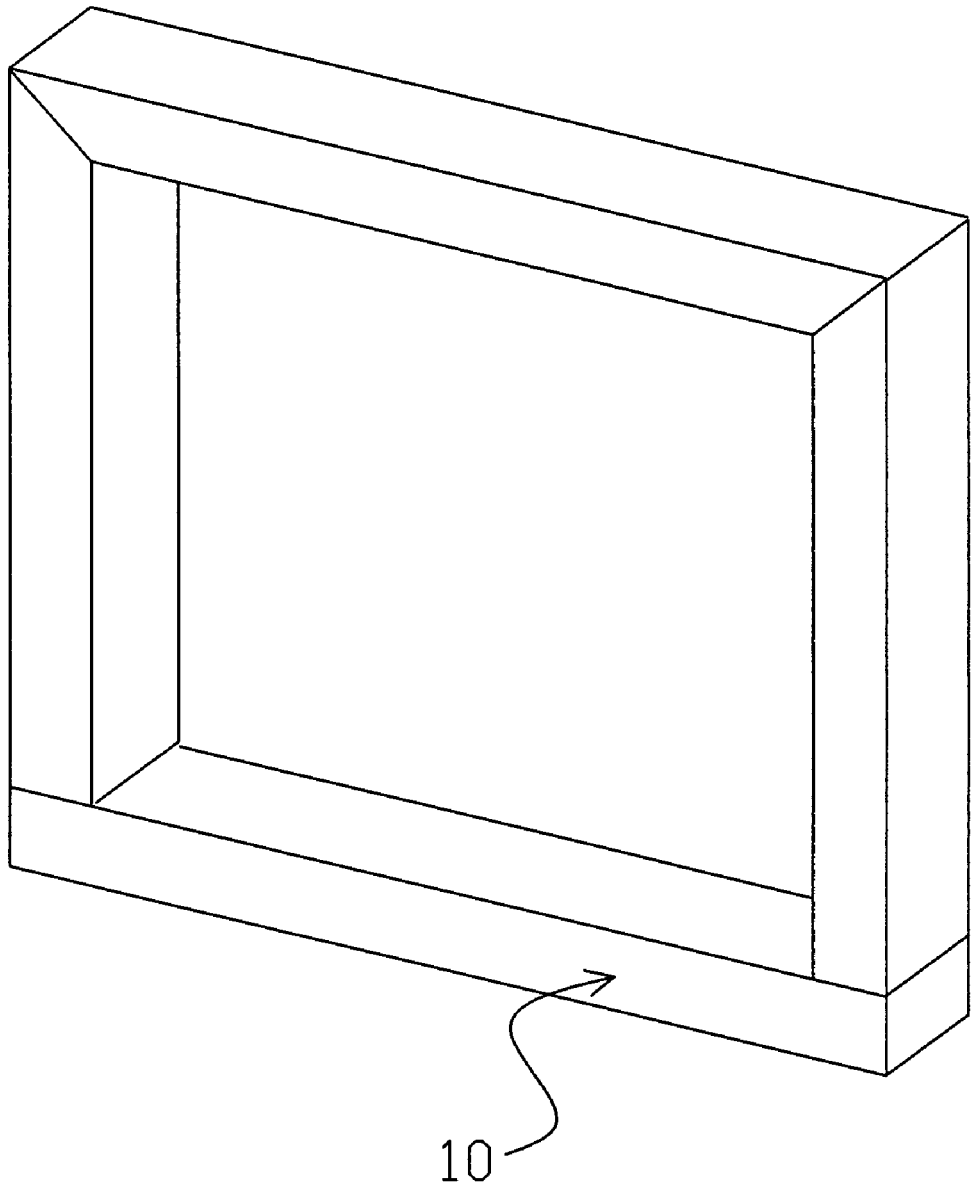

Referring now more specifically to FIG. 5, illustrated therein is an alternate embodiment of end cap 10, wherein the alternate embodiment of FIG. 5 is substantially equivalent in form and function to that of the preferred embodiment detailed and illustrated in FIGS. 1-3 except as hereinafter specifically referenced. Specifically, the embodiment of FIG. 5 contemplates that end cap 10 could be modified to permit adaptation of same to window frames.

It is contemplated in an alternate embodiment that end cap 10 could be modified to receive and engage the entire length of a selected doorjamb.

It is contemplated in an alternate embodiment that end cap 10 could be modified to receive and engage a selected portion of a doorframe.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A method of protecting a doorjamb from rot-inducing air, moisture and foreign particulates, said method comprising the steps of:

a.) obtaining a doorjamb end cap comprising a peripheral wall integrally formed with a bottom wall, said peripheral wall and said bottom wall defining a recess dimensioned to receive at least a portion of the doorjamb therein;

a.) scaling down all surfaces of the portion of the doorjamb;

b.) fitting the portion of the doorjamb with said end cap; and c.) facilitating flush surface seating and engagement of said end cap over the portion of the doorjamb.

2. The method of claim 1, wherein said step of scaling down all surfaces of the portion of the doorjamb includes scaling down the portion to a depth equivalent to the thickness of said peripheral wall of said end cap, and to a length equivalent to the length of said peripheral wall, thereby creating a lip around the doorjamb.

3. The method of claim 2, further comprising the step of slidably engaging said end cap over the scaled-down portion of the doorjamb such that an upper peripheral edge of said peripheral wall abuts the lip of the doorjamb.

4. The method of claim 3, further comprising the step of placing a foaming and sealing agent within a fractional gap disposed between an inner surface of said end cap and an outer surface of the portion of the doorjamb, thereby prohibiting the entry of rot-inducing air, moisture and/or foreign particulates therein.

5. The method of claim 4, further comprising the step of sealing a seam formed between said upper peripheral edge of said peripheral wall and the lip of the doorjamb.

6. The method of claim 5, wherein said step of sealing the seam includes applying a sealant thereover and selectively therebetween for creating an additional protective barrier.

7. The method of claim 6, further comprising the step of painting at least said end cap.

8. The method of claim 1, wherein the portion of the doorjamb is pre-manufactured to a select dimension to facilitate flush surface seating and engagement of said end cap thereover.

9. A method of protecting a base portion of door structure from rot-inducing air, moisture and foreign particulates, said method comprising the steps of:

a.) obtaining an end cap comprising a peripheral wall integrally formed with a bottom wall, said peripheral wall and said bottom wall defining a recess dimensioned to receive the portion of the door structure therein;

b.) fitting the portion of the door structure with said end cap;

c.) facilitating flush surface seating and engagement of said end cap over the portion of the door structure; and d.) scaling down all surfaces of the portion of the door structure.

10. The method of claim 9, wherein said step of scaling down all suffaces of the portion of the door structure includes scaling down the portion to a depth equivalent to the thickness of said peripheral wall of said end cap, and to a length equivalent to the length of said peripheral wall, thereby creating a lip around the door structure.

11. The method of claim 10, further comprising the step of slidably engaging said end cap over the scaled-down portion of the door structure such that an upper peripheral edge of said peripheral wall abuts the lip of the door structure.

12. The method of claim 11, further comprising the step of placing a foaming and sealing agent within a fractional gap disposed between an inner surface of said end cap and an outer surface of the portion of the door structure, thereby prohibiting the entry of rot-inducing air, moisture and/or foreign particulates therein.

13. The method of claim 12, further comprising the step of sealing a seam formed between said upper peripheral edge of said peripheral wall and the lip of the door structure.

14. The method of claim 13, wherein said step of sealing the seam includes applying a sealant thereover and selectively therebetween for creating an additional air and/or moisture barrier.

15. The method of claim 14, further comprising the step of painting at least said end cap.

16. The method of claim 9, wherein the portion of the door structure is pre-manufactured to a select dimension to facilitate flush surface seating and engagement of said end cap thereover.

17. The method of claim 9, wherein the door structure is selected from the group consisting of doorjambs, doorframes and doors.

* * * * *